US007671805B2

(12) United States Patent
Yamada et al.

(10) Patent No.: US 7,671,805 B2
(45) Date of Patent: Mar. 2, 2010

(54) ANTENNA APPARATUS AND ARTICLE MANAGEMENT SYSTEM

(75) Inventors: Akiko Yamada, Yokohama (JP); Shuichi Sekine, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 293 days.

(21) Appl. No.: 11/747,474

(22) Filed: May 11, 2007

(65) Prior Publication Data

US 2007/0262903 A1 Nov. 15, 2007

(30) Foreign Application Priority Data

May 12, 2006 (JP) ..... P2006-134545

(51) Int. Cl.
*H01Q 1/38* (2006.01)

(52) U.S. Cl. ..... 343/700 MS; 343/702; 343/749

(58) Field of Classification Search ..... 343/700 MS, 343/702, 745, 749
See application file for complete search history.

(56) References Cited

U.S. PATENT DOCUMENTS

| | | | | |
|---|---|---|---|---|
| 2,236,393 | A | 3/1941 | Beck et al. | |
| 3,605,097 | A * | 9/1971 | Hadik-Barkoczy | 343/739 |
| 4,115,780 | A * | 9/1978 | Goodman | 343/739 |
| 6,674,405 | B2 * | 1/2004 | Wang | 343/700 MS |
| 2003/0206107 | A1 | 11/2003 | Goff et al. | |
| 2005/0045724 | A1 | 3/2005 | Tsirline et al. | |
| 2005/0274799 | A1 | 12/2005 | Torchalski et al. | |
| 2006/0109496 | A1 | 5/2006 | Brown et al. | |
| 2007/0268143 | A1 * | 11/2007 | Copeland et al. | 340/572.7 |
| 2008/0007457 | A1 * | 1/2008 | Copeland et al. | 343/700 MS |

FOREIGN PATENT DOCUMENTS

| | | |
|---|---|---|
| DE | 26 06 271 | 8/1976 |
| GB | 2 107 936 | 5/1983 |
| JP | 2005-247566 | 9/2005 |

OTHER PUBLICATIONS

U.S. Appl. No. 12/233,923, filed Sep. 19, 2008, Yamada, et al.

* cited by examiner

*Primary Examiner*—Tan Ho
(74) *Attorney, Agent, or Firm*—Kimble Intellectual Property Law, PLLC

(57) ABSTRACT

According to an aspect of the invention, there is provide an antenna apparatus including: a conductive element including one end connected to a ground plane via a terminating resistor and the other end to which a power is supplied; and at least one branch conductive element branching from the conductive element and having a tip end which is short-circuited to the ground plane, and an element length of the branch conductive element being approximately a quarter wavelength of an operation frequency.

15 Claims, 11 Drawing Sheets

ANTENNA APPARATUS AND ARTICLE MANAGEMENT SYSTEM

CROSS-REFERENCE TO RELATED APPLICATIONS

This application is based on and claims the benefit of priority from the prior Japanese Patent Application No. 2006-134545, filed on May 12, 2006; the entire contents of which are incorporated herein by reference.

TECHNICAL FIELD

The present invention relates to an antenna apparatus and an article management system.

BACKGROUND

Description of Related Art

JP-A-2005-247566 discloses that a system manages a plurality of articles by attaching wireless tags and reading information written on the wireless tags.

In the above system, the plurality of articles, to which the wireless tags are attached, are housed in a carrier case. An antenna is mechanically moved in a direction of aligning the articles housed in the carrier case by an antenna moving mechanism, and thus the information written on the plurality of wireless tags are read in order. The system includes a controller for generating information regarding a position of the wireless tag from information regarding a position of the antenna when a tag number assigned to the wireless tag is read.

However, since an antenna is mechanically moved in the above system, an antenna moving mechanism and a controller for controlling the same are required, and thus the entire system becomes complicated and large. In addition, there is a possibility that trouble is caused in a mechanical mechanism such as an antenna moving mechanism.

Furthermore, in the above system, information of a wireless tag is read while the antenna is moving and radiating an electromagnetic wave, and thus interference with another wireless device is necessarily suppressed.

SUMMARY

According to an aspect of the invention, there is provided an antenna apparatus and article management system capable of reading information of a plurality of wireless tags without mechanically moving the antenna, and of suppressing unnecessary wave radiation.

According to another aspect of the invention, there is provided an antenna apparatus including: a conductive element comprising one end connected to a ground plane via a terminating resistor and the other end to which a power is supplied; and at least one branch conductive element branching from the conductive element and having a tip end which is short-circuited to the ground plane, and an element length of the branch conductive element being approximately a quarter wavelength of an operation frequency.

According to another aspect of the invention, there is provided an antenna apparatus including: a conductive element comprising one end connected to a ground plane via a terminating resistor and the other end to which a power is supplied; and at least one branch conductive element branching from the conductive element and having an open tip end, and an element length of the branch conductive element being approximately a half wavelength of an operation frequency.

According to another aspect of the invention, there is provided an article management system including: an antenna apparatus including: a conductive element comprising one end connected to a ground plane via a terminating resistor and the other end to which a power is supplied; and at least one branch conductive element branching from the conductive element and having a tip end which is short-circuited to the ground plane, and an element length of the branch conductive element being approximately a quarter wavelength of an operation frequency; a transmitting unit configured to transmit a signal to a wireless tag provide on an article via the antenna apparatus; and a receiving unit configured to receiving the signal from the wireless tag.

BRIEF DESCRIPTION OF THE DRAWINGS

In the accompanying drawings.

DESCRIPTION OF THE EMBODIMENTS

Embodiments of the present invention will be described below with reference to the accompanying drawings.

First Embodiment

An article management system according to a first embodiment of the present invention will be described with reference to FIGS. 1 to 7.

Figure 1:
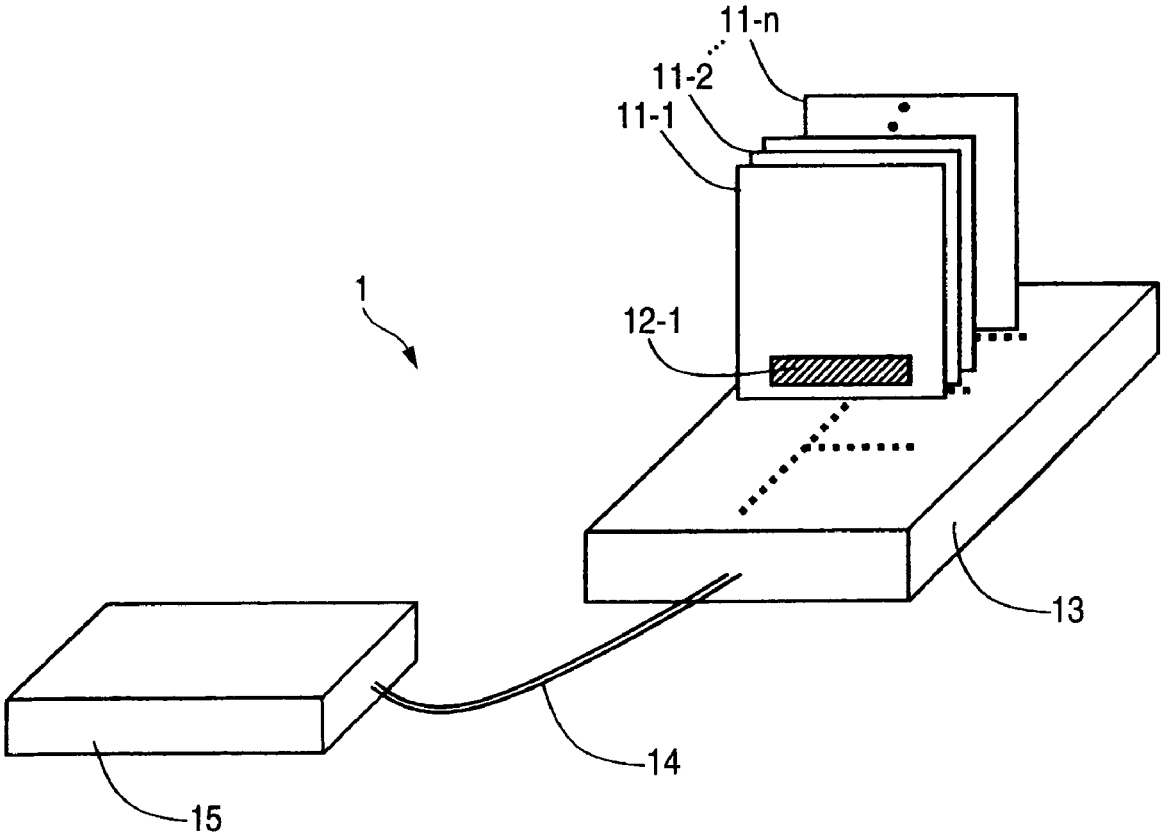
FIG. 1 is an exemplary view showing an article management system according to a first embodiment of the present invention.

FIG. 1 is a view showing the article management system according to the present embodiment. A document managing apparatus 1 manages a plurality of documents 11-1, 11-2, . . . , **11-*n* by reading information written on or writing information onto wireless tags 12-1, 12-2, . . . , 12-*n* attached to the plurality of the documents 11-1, 11-2, . . . , 11-*n*. An ID unique to each wireless tag, a title of the document, etc., are written on each of the wireless tags 12-1, 12-2, . . . , 12-*n*. Hereinafter, the information written on the wireless tags 12-1, 12-2, 12-*n*** will be referred to as document information. The document managing apparatus 1 reads the document information written on the wireless tags 12-1, 12-2, . . . , **12-*n* to manage articles based on the read document information. In addition, new document information is written on wireless tags 12-1, 12-2, 12-*n*** in the case where, for example, a new document is added, or the title of the document is re-written.

Figure 2:
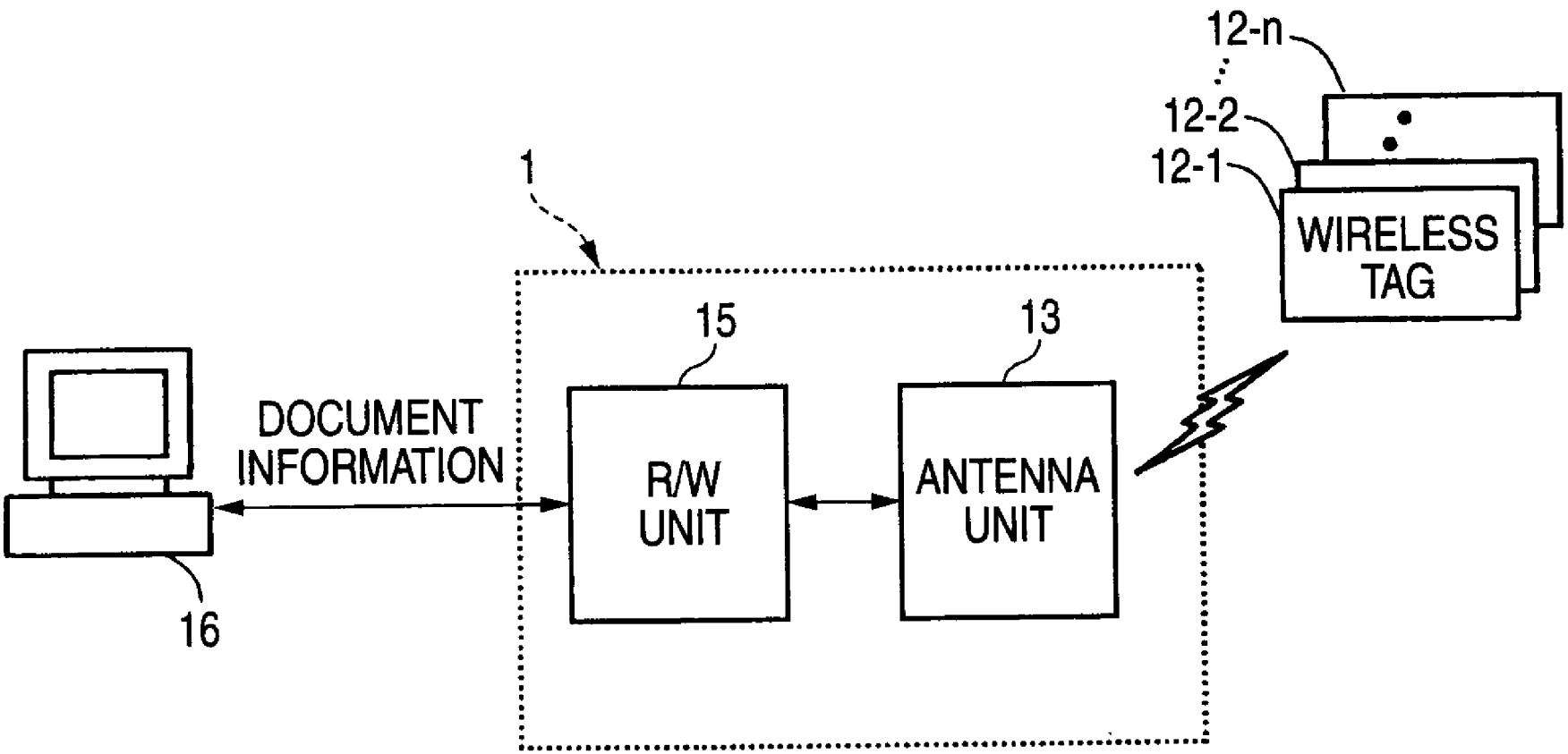
FIG. 2 is an exemplary block diagram showing a document managing apparatus 1 according to the first embodiment.

Next, a constitution of the document managing apparatus 1 will be described with reference to FIGS. 2 to 4.

A Read/Write (R/W) unit 15 is connected to a computer (PC) 16 for managing the document information. The Read/Write (R/W) unit 15 outputs the document information read from the wireless tag via an antenna unit 13 to the PC 16. In addition, the Read/Write (R/W) unit 15 writes the document information received from the PC 16 onto the wireless tag.

Next, the antenna unit 13 will be described with reference to FIG. 3. The antenna unit 13 includes: a ground plane 130; a wire element 131 which is arranged approximately parallel with the ground plane 130 at a predetermined interval, and has one end to which power is supplied via a feed point 133; a terminating resistor 134 connected between the other end of the wire element 131 and the ground plane 130; a plurality of branch conductive elements 132-1, 132-2, . . . , **132-*n* (n=4 in FIG. 3) connected on an identical plane with and perpendicularly to the wire element 131; and a housing (not shown) for incorporating the antenna unit 13 therein. Moreover, connection points between the wire element 131 and the branch conductive elements 132-1, 132-2, . . . , 132-*n* will be referred to as connection points 132-1*a*, 132-2*a*, . . . , 132-*na* respectively. Although the conductive element 131 is wire in the present embodiment, the shape of the conductive element 131** is not limited to the wire.

In addition, the terminating resistor 134 may be selected so that impedance of the terminating resistor 134 corresponds to a characteristic impedance of a feed line (not shown) connected to the wire element 131 via the feed point 133.

Each element length of the branch conductive elements 132-1, 132-2, . . . , **132-*n* is approximately a quarter wavelength of an operation frequency. One end of each branch conductive element is perpendicularly connected to the wire element 131, and the other ends of the branch conductive elements are grounded (short-circuited) at connection points 132-1*b*, 132-2*b*, 132-*nb* on the ground plane 10 respectively. Therefore, the connection points 132-1*a*, 132-2*a*, . . . , 132-*na* between the wire element 131 and the branch conductive elements 132-1, 132-2, . . . , 132-*n* are in a high impedance compared with the wire element 131. As a result, little current flows through the branch conductive elements 132-1, 132-2, . . . , 132-*n***.

(Modification of Antenna Unit 13)

Figure 3:
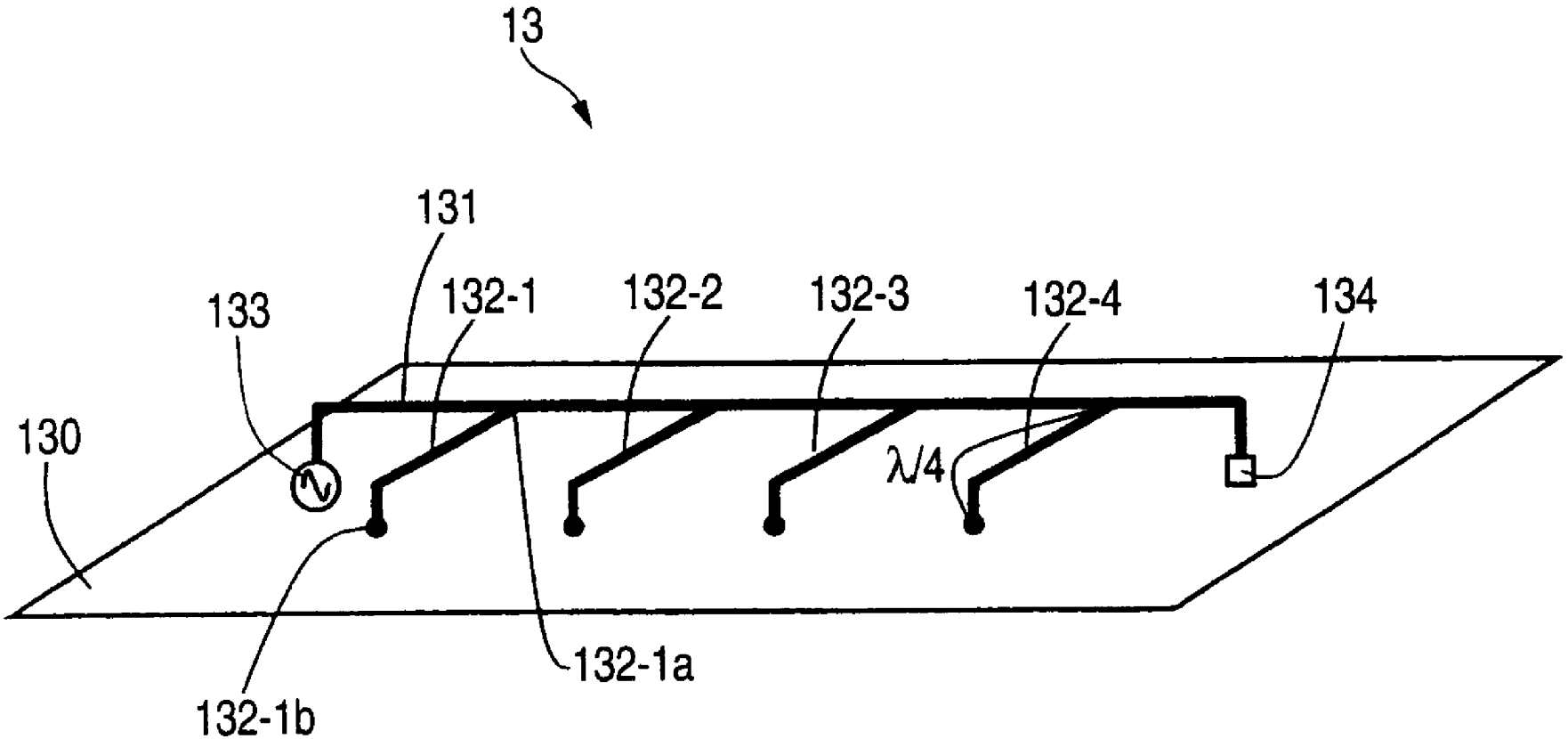
FIG. 3 is an exemplary perspective view showing an antenna unit 13 according to the first embodiment.
Figure 4:
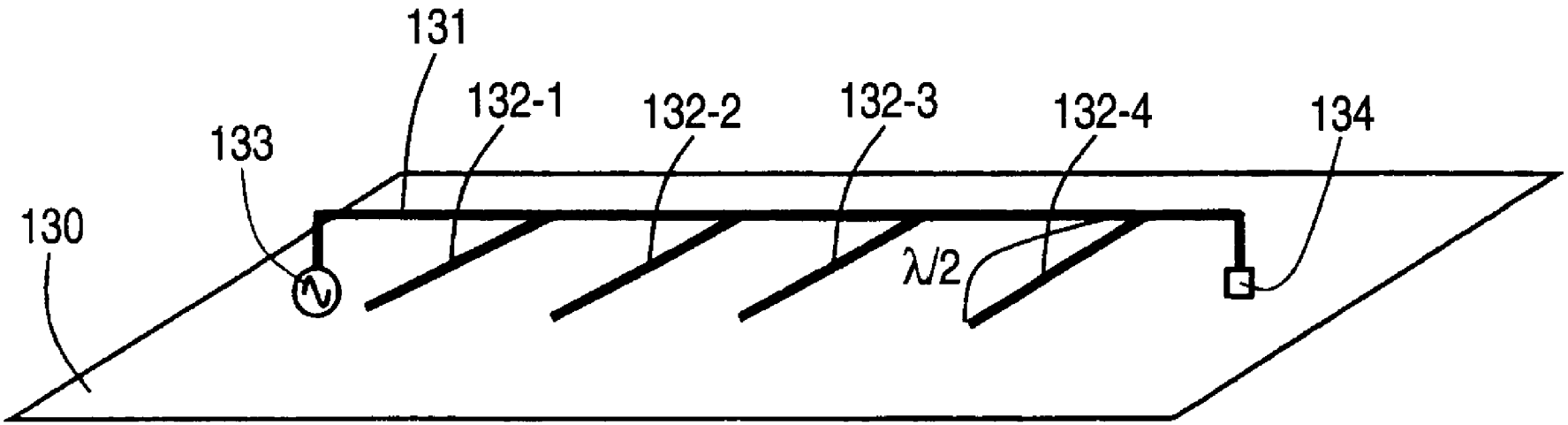
FIG. 4 is an exemplary plan view showing a modification of the antenna unit 13 according to the first embodiment.

FIG. 3 shows the case where each element length of the branch conductive elements 132-1, 132-2, . . . , **132-*n* is approximately a quarter wavelength of the operation frequency. However, each element length of the branch conductive elements may be approximately a half wavelength of the operation frequency. Here, the operation frequency indicates an approximate center frequency of a frequency band used for communication between the wireless tags 12-1, 12-2, . . . , 12-*n* and the document managing apparatus. FIG. 4 shows a constitution of the antenna unit 13 in the case where each element length of the branch conductive elements 132-1, 132-2, . . . , 132-*n* is approximately a half wavelength of the operation frequency. In this case, one end of each of the branch conductive elements 132-1, 132-2, . . . , 132-*n* is perpendicularly connected to the wire element 131**, and the other end thereof is opened.

Next, a constitution of each of the documents 11-1, 11-2, . . . , **11-*n* to be managed by the article managing apparatus 1 will be described. The wireless tags 12-1, 12-2, . . . , 12-*n* are attached to the documents 11-1, 11-2, . . . , 11-*n* respectively. Since constitutions and operations of the respective wireless tags 12-1, 12-2, . . . , 12-*n* are the same, only the wireless tag 12-1** will be described below.

Figure 5:
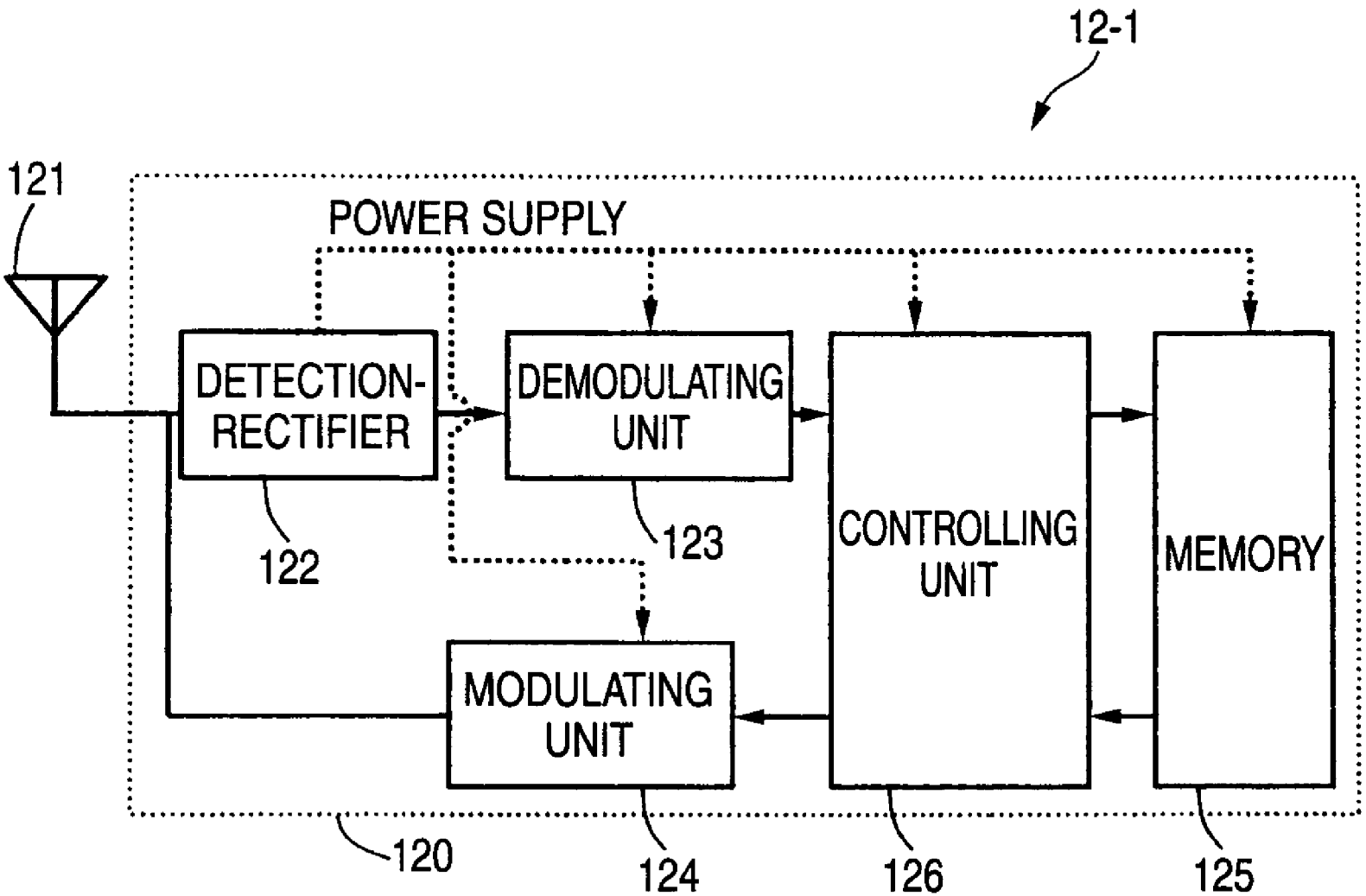
FIG. 5 is an exemplary block diagram showing a wireless tag 12-1 according to the first embodiment.

FIG. 5 is a block diagram showing the wireless tag 12-1.

In the wireless tag 12-1, an IC 120 is directly mounted on an antenna 121. The IC 120 includes: a detection-rectifier 122 for detecting a direct current DC for driving the IC 120 from a reception signal; a demodulating unit 123 for demodulating the reception signal; a modulating unit 124 for modulating a signal to be transmitted; a memory 125 for storing information, etc., of the document 11-1; and a controlling unit 126 for controlling each unit.

As the antenna 121, for example, a dipole antenna, a Yagi-Uda antenna or a micro-strip antenna may be employed. In the antenna 121, for example, the dipole antenna, when the document 11-1 is put in the vicinity of the antenna unit 13 of the document managing apparatus 1, the branch conductive elements 132-1, 132-2, . . . , **132-*n* (see FIG. 3) of the antenna unit 13 are arranged so as to be approximately parallel with the antenna 121. Thus, a polarization direction of the antenna 121 corresponds to each polarization direction of the branch conductive elements 132-1, 132-2, . . . , 132-*n* of the antenna unit 13**.

Next, operation of the article management system according to the first embodiment will be described. Here, it is assumed that the document 11-1, to which the wireless tag 12-1 is attached, is in the vicinity of the branch conductive element 132-1 of the antenna unit 13. Operations of the other documents 11-2, . . . , **11-*n* and the branch conductive elements 132-2, . . . , 132-*n* are the same as those of the document 11-1 and the branch conductive element 132-1** respectively.

First, operation of the antenna unit 13 will be described with reference to FIGS. 6A and 6B.

Figure 6A:
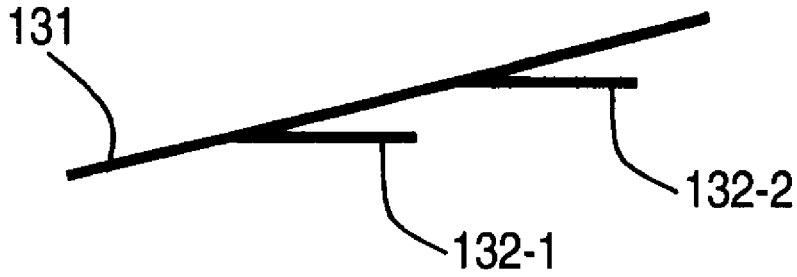
FIGS. 6A and 6B are exemplary views showing operations of the antenna unit 13 according to the first embodiment.

FIG. 6A is a view showing operations in the case where the wireless tag 12-1 is not in the vicinity of the antenna unit 13. As described above, since the connection points **132-1*a*, 132-2*a* between the wire element 131 and the branch conductive elements 132-1, 132-2 are in high impedance compared with the wire element 131, little current flows through the branch conductive elements 132-1, 132-2. Thus, when no wireless tag is in the vicinity of the branch conductive elements 132-1, 132-2, no electromagnetic wave is radiated from the branch conductive elements 132-1, 132-2**.

Figure 6B:
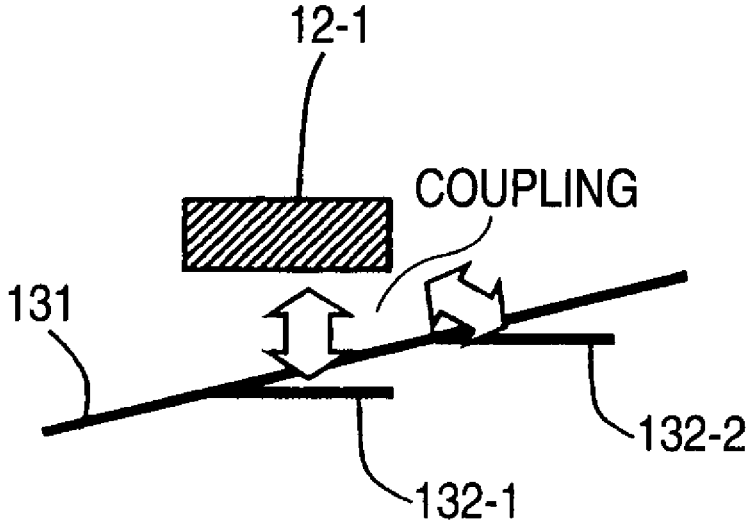

On the other hand, FIG. 6B is a view showing operations in the case where the wireless tag 12-1 is in the vicinity of the branch conductive element 132-1 of the antenna unit 13. In this case, electro-magnetic field coupling is generated between the wireless tag 12-1 and the branch conductive elements 132-1, 132-2. Thus, a reception voltage is generated in the antenna 121 incorporated in the wireless tag 12-1, and power is supplied to the IC 120. Whereby, the wireless tag 12-1 transmits information stored in the memory 125, and the antenna unit 13 receives the information.

Next, operations of the article managing apparatus 1 and the wireless tag 12-1 in the case where the wireless tag 12-1 is in the vicinity of the antenna unit 13 will be described with reference to FIGS. 2 and 5.

A wave (referred to as reception signal, hereinafter) radiated from the branch conductive element 132-1 is input to the detection-rectifier 122 via the antenna 121. The detection-rectifier 122 detects the direct current DC from the input reception signal to supply power to each unit of the IC 120. On the other hand, the detection-rectifier 122 inputs the reception signal to the demodulating unit 123. The demodulating unit 123 subjects the input reception signal to demodulation, etc., and inputs the results to the controlling unit 126. The controlling unit 126 writes the results received from the demodulating unit onto the memory 125. As a result of the demodulation, when the document managing apparatus 1 reads the document information, the controlling unit 126 generates a transmission signal with reference to the memory 125. The controlling unit outputs the transmission signal to the modulating unit 124. The modulating unit 124 subjects the input transmission signal to encoding, etc., turns a switch therein on/off, and changes impedance of the antenna 121 to transmit a signal.

The R/W unit 15 receives the signal transmitted from the wireless tag 12-1 via the antenna unit 13, and subjects the received signal to demodulation etc., to obtain the document information. Next, the R/W unit 15 outputs the obtained document information to the PC 16. Then, the PC 16 manages the document 11-1 based on the input document information.

On the other hand, when the document information is written onto the wireless tag 12-1, the document information to be written on is input into the R/W unit 15 via the PC. The R/W unit 15 subjects the input document information to modulation, etc., to generate a transmission signal. The transmission signal is transmitted to the wireless tag 12-1 via the antenna unit 13.

Next, the case where the article management system according to the present embodiment is applied to a rack for housing articles will be described with reference to FIG. 7.

Figure 7:
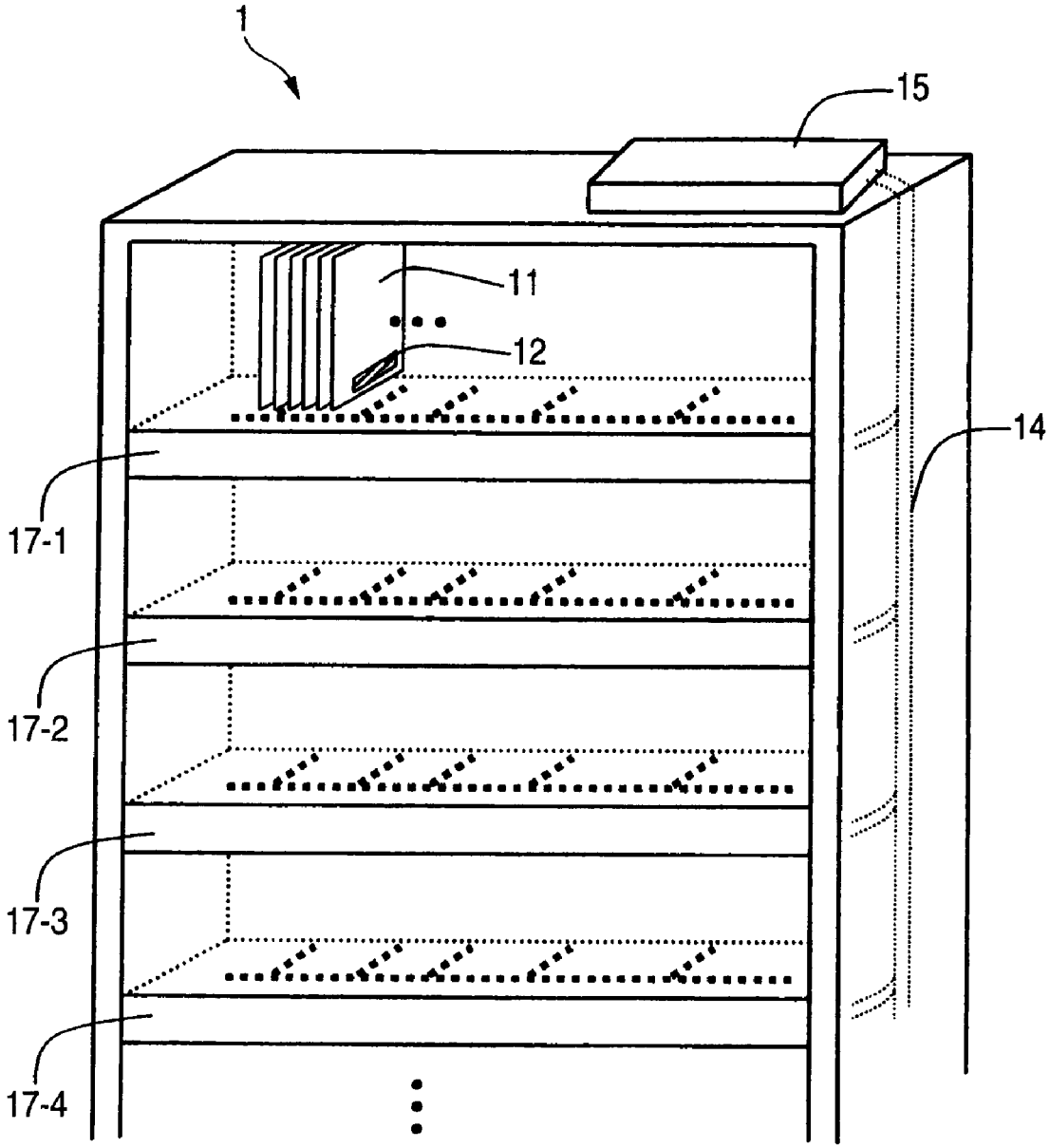
FIG. 7 is an exemplary view showing a rack to which the article management system according to the first embodiment.

The rack, to which the article management system shown in FIG. 7 is applied, includes: a plurality of rack plates 17-1, 17-2, . . . , each having the antenna unit 13; and the R/W unit 15 provided on an upper surface thereof. The antenna units 13, which are provided in the plurality of rack plates 17-1, 17-2, . . . respectively, are connected to the R/W unit 15 via a coaxial cable 14.

The R/W unit 15 is connected to the PC 16 for managing the article (not shown in FIG. 7), and outputs information of the article (the document 11 to which the wireless tag 12 is attached, in FIG. 7) received via the antenna unit 13 to the PC 16.

Since operations of the article management system applied to the rack is the same as that of the article management system shown in FIG. 1, a description of the operation will be omitted. In addition, the R/W unit 15 is not always required to be provided on the upper surface of the rack, and may be provided on a lower surface thereof.

As described above, in the first embodiment, a plurality of the branch conductive elements 132-1, 132-2, . . . , **132-*n* are aligned to communicate with the wireless tags in the vicinity thereof. Thus, the information of the plurality of wireless tags can be read without mechanically moving the antenna unit 13. In addition, since no current flows through the branch conductive element having no wireless tag in the vicinity thereof, the branch conductive elements 132-1, 132-2, . . . , 132-*n*** radiate no unnecessary wave except for the case where the wireless tags are in the vicinity thereof. Accordingly, interference with another wireless device can be suppressed.

Furthermore, the wire element 131 and the branch conductive elements 132-1, 132-2, . . . , **132-*n* are connected on an identical plane and perpendicularly to each other, so that an unnecessary electromagnetic field coupling therebetween can be suppressed. If the unnecessary electromagnetic field coupling is caused between the wire element 131 and the branch conductive elements 132-1, 132-2, . . . , 132-*n*, each resonance frequency of the branch conductive elements 132-1, 132-2, . . . , 132-*n* varies. As a result, a capacity of the antenna unit for reading the information transmitted from the wireless tag is lowered. In the case where the antenna apparatus is designed after the unnecessary electromagnetic field coupling is considered in advance, a significantly large resource is required for design. It is very important to suppress the unnecessary electromagnetic field coupling between the wire element 131 and the branch conductive elements 132-1, 132-2, . . . , 132-*n*, or between the branch conductive elements 132-1, 132-2, . . . , 132-*n*** in advance.

Second Embodiment

Next, an article management system according to a second embodiment of the present invention will be described with reference to FIGS. 8 to 11. Since a constitution and operation of the article management system according to the second embodiment is the same as those of the article management system shown in FIG. 1 except for a constitution of an antenna unit 13, the same reference symbols are assigned to the same units respectively other than the antenna unit 13, and a description of the same units will be omitted.

Figure 8:
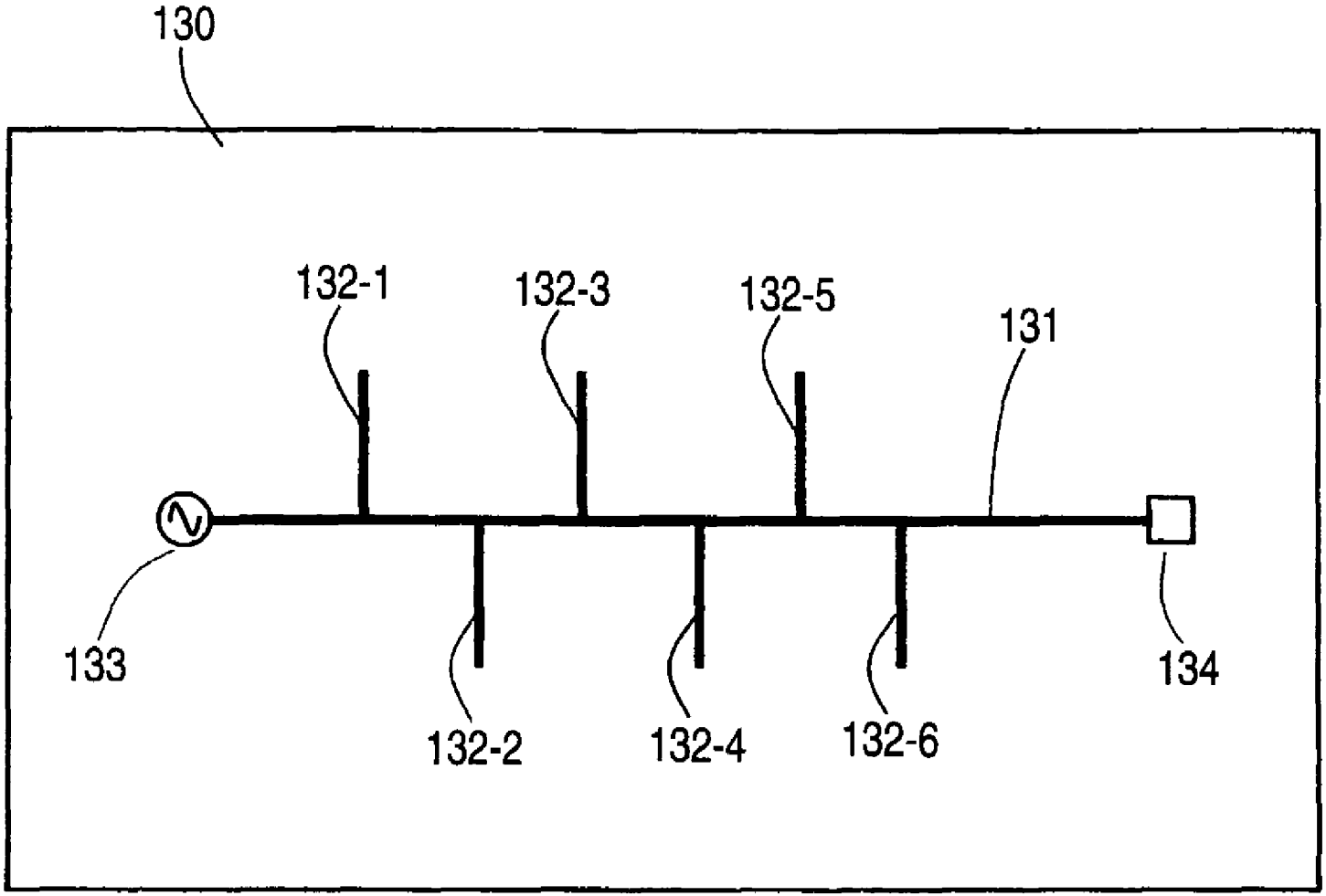
FIG. 8 is an exemplary perspective view showing an antenna unit 13 according to a second embodiment of the present invention.

FIG. 8 is a perspective view of the antenna unit 13 according to the present embodiment. The constitution of the antenna unit shown in FIG. 8 is approximately the same as that of the antenna unit 13 shown in FIG. 3. However, in the antenna unit 13 of the present embodiment, the plurality of branch conductive elements 132-1, 132-2, . . . , **132-*n* (n=6 in FIG. 8) are alternatively arranged on either side of the wire element 131**.

Thus, an interval between the branch conductive elements adjacent to each other is widened, and the electromagnetic field coupling between the branch conductive elements is weakened.

Next, a modification of the antenna unit 13 according to the present embodiment will be described with reference to FIGS. 9 to 11.

[First Modification]

Figure 9:
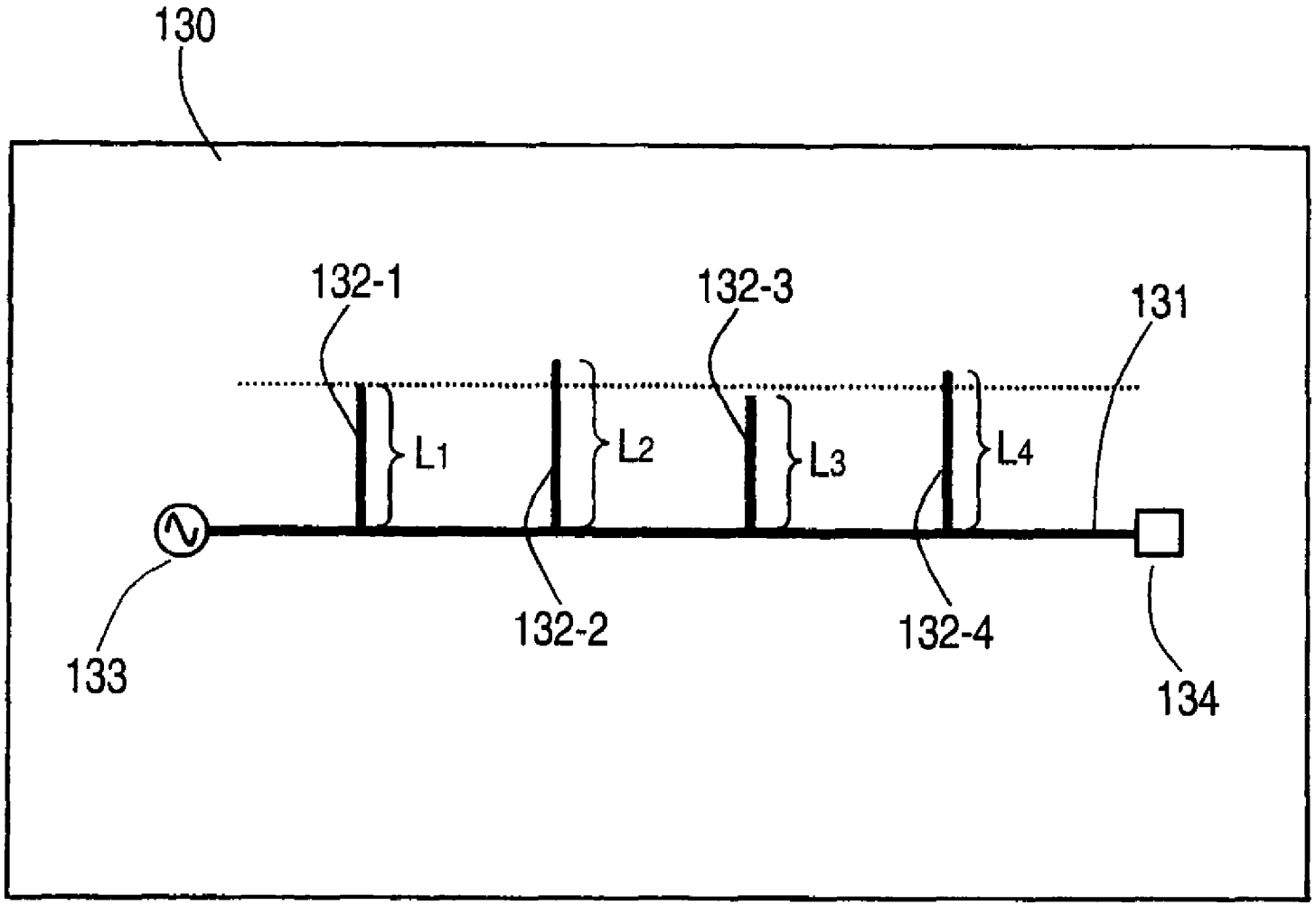
FIG. 9 is an exemplary plan view showing a first modification of the antenna unit 13 according to the second embodiment.

FIG. 9 is a plan view showing the modification of the antenna unit 13 according to the embodiment.

A constitution of an antenna unit shown in FIG. 9 is approximately the same as that of the antenna unit shown in FIG. 3 except for a point that the element lengths L1, L2, Ln of the branch conductive elements 132-1, 132-2, . . . , **132-*n*** are slightly different from each other.

Since element lengths L1, L2, . . . , Ln are different from each other, the resonance frequencies of the branch conductive elements are slightly different from each other. Thus, the electromagnetic field coupling between the branch conductive elements is weakened, and the branch conductive elements hardly resonate with each other. However, since the element lengths L1, L2, . . . , Ln are slightly different from the quarter wavelengths of the operation frequency of the branch conductive elements 132-1, 132-2, . . . , **132-*n***, respectively, each branch conductive element resonates with the electromagnetic wave of the operation frequency. Moreover, although the element lengths of the branch conductive elements are different from each other in the first modification, only the element lengths of the two branch conductive elements adjacent to each other may be different from each other.

[Second Modification]

Figure 10:
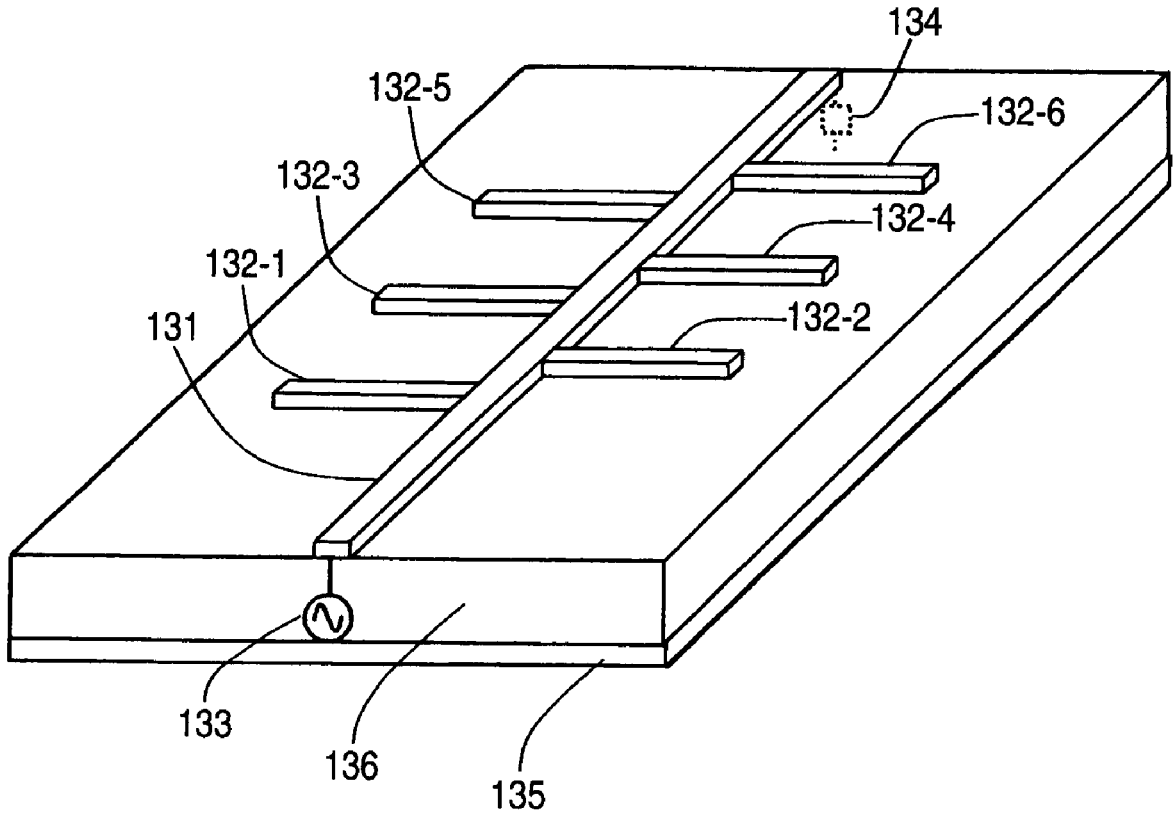
FIG. 10 is an exemplary perspective view showing a second modification of the antenna unit 13 according to the second embodiment.

FIG. 10 is a perspective view showing a second modification of the antenna unit 13 according to the present embodiment.

In the modification of the antenna unit 13 shown in FIG. 10, the wire element 131 and the branch conductive elements 132-1, 132-2, . . . , **132-*n* of the antenna unit 13 shown in FIG. 8 serves as a micro-strip line. Furthermore, the antenna unit 13 shown in FIG. 10 includes: a ground 135 corresponding to the ground plane 130; and a dielectric 136 between the ground 135 and the wire element 131**.

[Third Modification]

Figure 11:
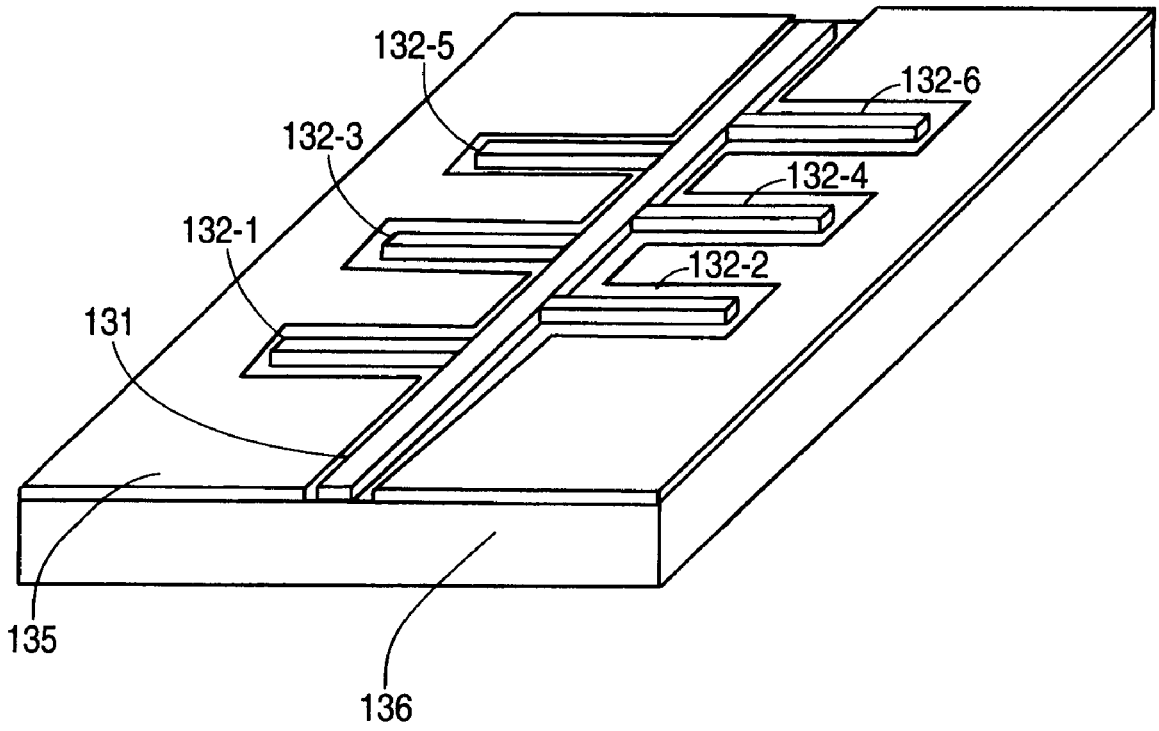
FIG. 11 is an exemplary perspective view showing a third modification of the antenna unit 13 according to the second embodiment.

FIG. 11 is a perspective view showing a third modification of the antenna unit 13 according to the present embodiment.

In the modification of the antenna unit 13 shown in FIG. 11, the wire element 131 and the branch conductive elements 132-1, 132-2, . . . , **132-*n* of the antenna unit 13 shown in FIG. 8 serves as a coplanar waveguide (CPW). That is, the wire element 131, the branch conductive elements 132-1, 132-2, . . . , 132-*n* and the ground 135** are constituted by a single conductor plate.

As described above, according to the second embodiment, the same effect as that of the first embodiment can be obtained. Furthermore, since the branch conductive elements 132-1, 132-2, . . . , **132-*n* are alternatively arranged on either side of the wire element 131, the interval between the elements can be widened even if the number of branch conductive elements 132-1, 132-2, . . . , 132-*n* is increased. Accordingly, the unnecessary electromagnetic field coupling between the branch conductive elements 132-1, 132-2, . . . , 132-*n*** can be suppressed.

Furthermore, as shown in the first modification, since the element lengths of the branch conductive elements 132-1, 132-2, . . . , **132-*n* are slightly different from each other, the resonance frequency of each branch conductive element is slightly changed, and the resonance between the branch conductive elements can be suppressed. Thus, the unnecessary electromagnetic field coupling between the branch conductive elements 132-1, 132-2, . . . , 132-*n*** can be suppressed.

Furthermore, as shown in the second modification, since the wire element 131 and the branch conductive elements 132-1, 132-2, . . . , **132-*n*** serve as the micro-strip line, the elements can be manufactured with a PCB (Print Circuit Board), etc., and productivity can be improved.

Similarly, as shown in the third modification, since the wire element 131 and the branch conductive elements 132-1, 132-2, . . . , **132-*n* serves as the coplanar waveguide, the ground plane 130, the wire element 131** and the branch conductive elements can be constituted by a single conductor plate, and the productivity can be improved.

According to the antenna apparatus and article management system of the present embodiment, the information of the plurality of wireless tags can be read without mechanically moving the antenna. Unnecessary wave radiation can thus be suppressed.

Moreover, the present invention is not limited only to the above embodiments, and can be modified without departing from the scope thereof in being carried out. In addition, various inventions can be made by properly combining a plurality of components used in the above embodiments. For example, some components may be removed from all the components used in the above embodiments. Alternatively, the components used in the embodiments different from each other may be properly combined with each other.

What is claimed is:

1. An antenna apparatus comprising:

a conductive element comprising one end connected to a ground plane via a terminating resistor and the other end to which a power is supplied; and at least one branch conductive element branching from the conductive element and having a tip end which is short-circuited to the ground plane, and an element length of the branch conductive element being approximately a quarter wavelength of an operation frequency.

2. The antenna apparatus according to claim 1, wherein the conductive element is wire.

3. The antenna apparatus according to claim 1, wherein the conductive element and the at least one branch conductive element are arranged on an approximately same plane, and wherein the at least one branch conductive element approximately perpendicularly branches from the conductive element.

4. The antenna apparatus according to claim 1, wherein the at least one branch conductive element is alternatively arranged on either side of the conductive element.

5. The antenna apparatus according to claim 1, wherein the at least one branch conductive element comprises a plurality of branch conductive elements, element lengths of at least two branch conductive elements being different from each other, wherein at least one of the plurality of the branch conductive elements resonates with an electromagnetic wave having the operation frequency.

6. The antenna apparatus according to claim 1, wherein the conductive element and the at least one branch conductive element constitute a micro-strip line.

7. The antenna apparatus according to claim 1, wherein the conductive element and the at least one branch conductive element serves as a coplanar waveguide.

8. An antenna apparatus comprising:

a conductive element comprising one end connected to a ground plane via a terminating resistor and the other end to which a power is supplied; and at least one branch conductive element branching from the conductive element and having an open tip end, and an element length of the branch conductive element being approximately a half wavelength of an operation frequency.

9. The antenna apparatus according to claim 8, wherein the conductive element is wire.

10. The antenna apparatus according to claim 8, wherein the conductive element and the at least one branch conductive element are arranged on an approximately same plane, and wherein the at least one branch conductive element approximately perpendicularly branches from the conductive element.

11. The antenna apparatus according to claim 8, wherein the at least one branch conductive element is alternatively arranged on either side of the conductive element.

12. The antenna apparatus according to claim 8, wherein the at least one branch conductive element comprises a plurality of branch conductive elements, element lengths of at least two branch conductive elements being different from each other, wherein at least one of the plurality of the branch conductive elements resonates with an electromagnetic wave having the operation frequency.

13. The antenna apparatus according to claim 8, wherein the conductive element and the at least one branch conductive element constitute a micro-strip line.

14. The antenna apparatus according to claim 8, wherein the conductive element and the at least one branch conductive element serves as a coplanar waveguide.

15. An article management system comprising:

an antenna apparatus comprising:

a conductive element comprising one end connected to a ground plane via a terminating resistor and the other end to which a power is supplied; and at least one branch conductive element branching from the conductive element and having a tip end which is short-circuited to the ground plane, and an element length of the branch conductive element being approximately a quarter wavelength of an operation frequency;

a transmitting unit configured to transmit a signal to a wireless tag provide on an article via the antenna apparatus; and a receiving unit configured to receiving the signal from the wireless tag.

* * * * *